US005775924A

United States Patent [19]

Miskin et al.

[11] Patent Number: 5,775,924

[45] Date of Patent: Jul. 7, 1998

[54] MODULAR TERMINATING CONNECTOR WITH FRAME GROUND

[75] Inventors: Michael J. Miskin; Ed Seamands, both of Little Rock; Munawar Ahmad, Conway, all of Ark.

[73] Assignee: Molex Incorporated, Lisle, Ill.

[21] Appl. No.: 729,116

[22] Filed: Oct. 11, 1996

[51] Int. Cl.[6] ..... H01R 13/648

[52] U.S. Cl. ..... 439/98; 439/939

[58] Field of Search ..... 439/98, 99, 109, 439/95, 939, 608

[56] References Cited

U.S. PATENT DOCUMENTS

| | | | |
|---|---|---|---|
| 4,099,819 | 7/1978 | Keglewitsch | 339/75 |
| 4,337,989 | 7/1982 | Asick et al. | 339/143 |
| 4,381,129 | 4/1983 | Krenz | 439/939 |
| 4,484,792 | 11/1984 | Tengler et al. | 339/143 |
| 4,516,825 | 5/1985 | Brennan et al. | 339/143 |
| 4,550,960 | 11/1985 | Asick et al. | 339/14 |
| 4,603,936 | 8/1986 | Jagen | 339/143 |
| 4,984,992 | 1/1991 | Beamenderfer et al. | 439/108 |
| 5,112,251 | 5/1992 | Cesar | 439/939 |
| 5,184,965 | 2/1993 | Myschik et al. | 439/578 |
| 5,222,898 | 6/1993 | Fedder et al. | 439/101 |
| 5,328,380 | 7/1994 | Carney | 439/188 |
| 5,460,533 | 10/1995 | Broeksteeg et al. | 439/101 |
| 5,470,238 | 11/1995 | Walden | 439/98 |

FOREIGN PATENT DOCUMENTS

| | | |
|---|---|---|
| 0211496-A1 | 2/1987 | European Pat. Off. . |
| 0562691-A1 | 9/1993 | European Pat. Off. . |
| 0583111-A1 | 2/1994 | European Pat. Off. . |
| 07029638 | 1/1995 | Japan . |

*Primary Examiner*—Gary F. Paumen
*Attorney, Agent, or Firm*—A. A. Tirva

[57] ABSTRACT

A modular electrical terminating connector for data transmission cables of the type having signal carrying conductors, drain wires and a shield. The connector passes through a ground plate and includes a housing that mates with a complementary connector assembly of a backplane. Individual overmolded subassemblies for terminating each cable are detachably coupled to the housing. The subassemblies latch to the ground plate, and provide a ground path from the cable shield to the ground plate. The subassemblies are individually detachable, thereby enabling individual cables to be disconnected and serviced without disconnecting other cables of the same connector.

26 Claims, 2 Drawing Sheets

MODULAR TERMINATING CONNECTOR WITH FRAME GROUND

TECHNICAL FIELD OF THE INVENTION

The present invention relates generally to electrical connectors used in high speed data transmission, and more particularly to a connector having modular properties.

BACKGROUND OF THE INVENTION

Industries requiring high speed data transmission, such as the telecommunications industry, utilize cable assemblies having shielded connectors to terminate data transmission cables. One common type of data transmission cable has two signal carrying conductors with two drain wires surrounded by a braided ground shield. A number (e.g., three) of such cables are commonly terminated in a single such connector that is protected by a common overall housing, the common overall housing being conductive and in electrical contact with the braided ground shield of the cables. In operation, the connector is plugged through a ground plate and into a backplane of the equipment that receives and/or transmits the transmitted data. The common housing contacts the ground plate and thus acts as a shield.

However, although the above-described connectors function well, a technician typically must unplug the entire connector to service or replace one of the cables. In telecommunications applications, this disconnects all of the cables of the serviced connector, potentially interrupting service to thousands of customers. Nevertheless, the common overall shield-design is presently used because it provides desirable shielding and enables a number of cables to be terminated in a small amount of space. In particular, a connector having this common overall shield-design fits into a (dimensionally) standardized shroud that is present in existing backplane connectors.

OBJECTS AND SUMMARY OF THE INVENTION

Accordingly, it is an object of the present invention to provide an apparatus and method for constructing same for terminating a plurality of cables while allowing the cables to be individually connected and disconnected.

Another object is to provide a connector as characterized above comprising modular subassemblies.

Yet another object is to provide modular subassemblies of the above kind which, when combined, provide a connector that is compatible in size and shape with standardized connector specifications.

It is another object to provide a modular connector as characterized above that provides desired shielding.

Yet another object is to provide an apparatus of the above kind that employs a relatively simple and economical manufacturing method, while providing a sturdy and reliable connector.

Briefly, the present invention provides an apparatus (and method for constructing same) including an electrical terminating connector for at least one data transmission cable of the type having signal carrying conductors, drain wires, and a cable shield. The connector couples the signal carrying conductors and drain wires of the cable through a ground plate and to a backplane assembly. The connector comprises a housing adapted for mating with the backplane assembly, and modular subassemblies detachably coupled to the housing. Each subassembly includes terminals electrically coupled to the signal carrying conductors and the drain wires of the cable, and a latch mechanism for latching the subassembly to the ground plate. Each subassembly further includes grounding means adapted to be electrically coupled to the cable shield for providing a ground path from the cable shield to the ground plate.

Other objects and advantages will become apparent from the following detailed description when taken in conjunction with the drawings, in which:

Figure 1:
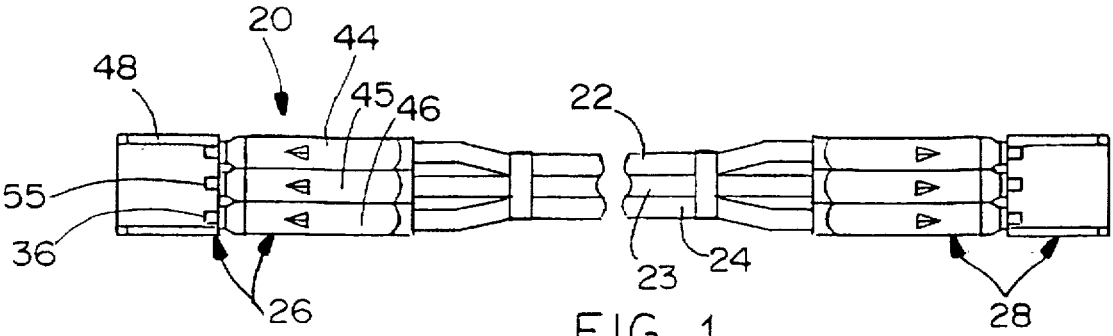
FIG. 1 is a top view illustrating a data transmission apparatus having three cables shown with terminating connectors at both ends thereof and constructed according to the invention.

While the invention is amenable to various modifications and alternative constructions, a certain illustrated embodiment thereof is shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention. For example, the invention is not limited to termination of cables having signal and drain conductors, but applies also to coaxial type cables having a signal conductor surrounded by a shield.

DETAILED DESCRIPTION OF THE PREFERRED EMBODIMENT

Figure 2:
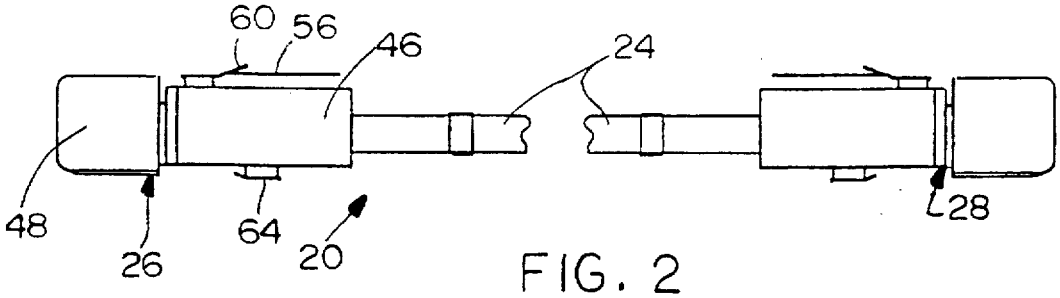
FIG. 2 is a side view of the apparatus of FIG. 1.
Figure 3:
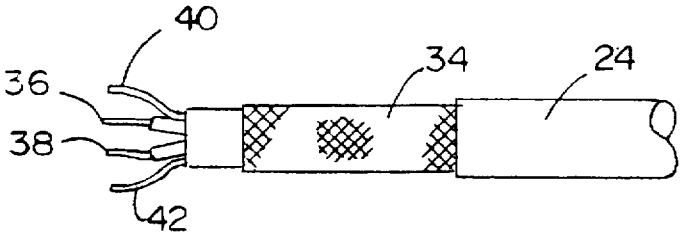
FIGS. 3–5 illustrate preparatory steps in constructing a modular terminating apparatus of the present invention.

Turning to the drawings and referring first to FIGS. 1 and 2, there is shown a data transmission apparatus generally designated 20 and constructed in accordance with the invention. In FIGS. 1 and 2, the data transmission apparatus 20 includes a plurality of cables 22–24, with each cable having an electrical terminating connector 26, 28 at opposed ends thereof. As shown in FIG. 3, each of the exemplified cables (e.g., cable 24) is of the type having a braided shield 34, two signal carrying conductors 36, 38, and two drain wires 40–42. Such cables are typically used in high speed data transmission such as in telecommunications applications or applications involving the transmission of computer signals.

Figure 7:
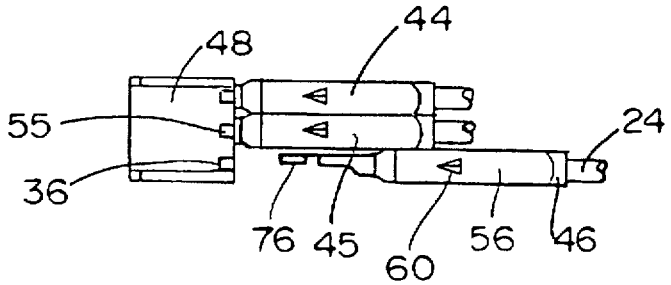
FIG. 7 is a top view illustrating three connectors and cables being plugged into a standard housing.
Figure 8:
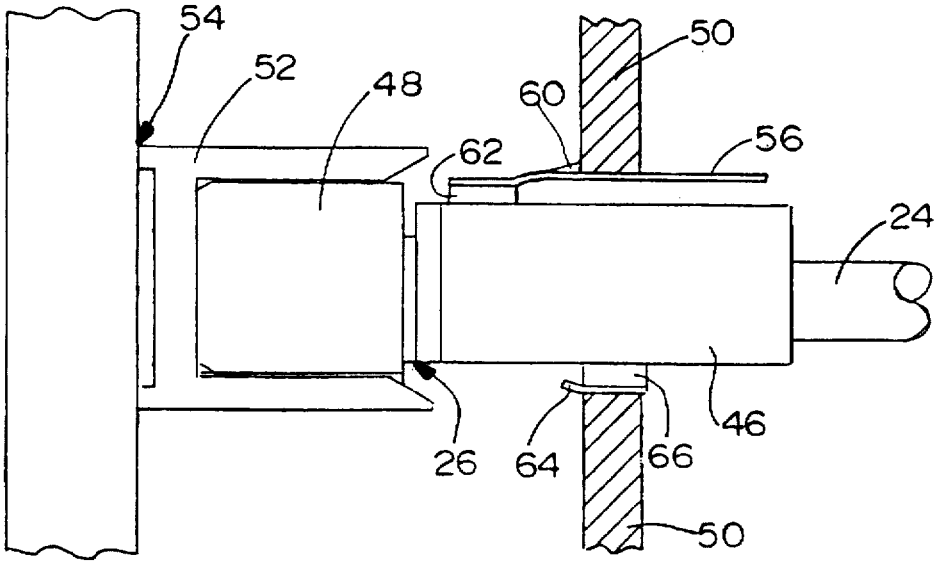
FIG. 8 is a side view illustrating the cables, connectors and housing of FIG. 7 plugged through a ground plate and into a complementary connector of a backplane.

As best shown in FIGS. 1, 2 and 7, and as described in more detail below, each terminating connector (e.g., connector 26) comprises a plurality of subassemblies 44–46 coupled to a common housing 48. As best shown in FIG. 8, the housing 48, when coupled to at least one of the subassemblies, (e.g. subassembly 46), may be plugged as a unitary terminating connector 26 through a ground plate 50 and into a complementary connector, or shroud 52, of a backplane assembly 54. At least the signal carrying conductors 36, 38 of the cable 24 are connected for communicating data therethrough to the backplane assembly 54. The shroud 52 may comply with standardized size and electrical connectivity specifications. For example, the shroud 52 shown in FIG. 8 may accept standard-size terminating connectors arranged to electrically couple to groups of three shielded cables, each cable having two signal carrying wires and two drain wires. Of course, it can be appreciated that the present invention is not limited to any particular size, grouping and/or types of cables. Moreover, it is understood that a single cable can consist of any number of signal carrying conductors and/or drain wires, e.g., the six signal-carrying conductors and six drain wires in the three cables of FIG. 1 may alternatively reside within a single physical cable and yet be coupled to any number of individual subassemblies.

According to one aspect of the invention, the terminating connector 26 comprises the modular subassemblies 44–46. In other words, the terminating connector includes subassemblies 44–46 for terminating each cable 22–24, respectively, wherein the subassemblies 44–46 may be individually plugged into and unplugged from the connector housing 48. Significantly, the plugging and unplugging operations may be accomplished while the terminating connector 26 is coupled to the backplane shroud connector 52. As a result, an individual subassembly such as subassembly 46 (and thus cable 24) may be disconnected for servicing or replacement without disconnecting the other subassemblies 44, 45 of the same connector 26, and then reconnected in the same, less-interruptive manner.

Moreover, when connected, the subassemblies 44–46 individually latch to the ground plate 50 to prevent inadvertent unplugging. To this end, each subassembly such as subassembly 46 of FIG. 6 includes at least one active latch mechanism 56 that latches with the ground plate 50 upon connection of the housing 48 to the backplane connector assembly 54. The latch mechanism 56 is resiliently deformable, and, as best shown in FIG. 8, includes a projecting barb 60 which prevents movement of the connector in the "unplugging" direction, e.g., toward the right in FIG. 8. For purposes of simplicity, the directional information referred to herein, (e.g., right, upper, lower, forward and so on), will correspond to the orientation shown in the drawings, although it is understood that the illustrated orientation is purely arbitrary and is not intended to limit the invention.

To accomplish the latching function, the latch mechanism 56 is tapered at its forward (left) end to facilitate its initial insertion through the ground plate 50. As evident from FIG. 8, upon further insertion, the slope of the barb 60 causes the latch mechanism 56 to mechanically contact the ground plate 50, deforming the free end of the latch mechanism 56 in a downward direction. Note that the ground plate 50 is rigidly coupled to the backplane assembly 54 and therefore can be considered relatively stationary. The deflection continues until the high end of the barb 60 passes the ground plate 50, (when the subassembly 46 is fully inserted through the ground plate opening 50), whereupon the latch mechanism 56 springs back and the barb 60 locks against the ground plate 50. This full insertion position is depicted in FIG. 8. As can be appreciated, to remove the subassembly 46, the latch mechanism 56 is pushed down to where the barb 60 is below the ground plate 50 and the subassembly is disengaged from the connector housing 48. To remove the entire connector 26, the latch mechanisms of all subassemblies 44–46 are pushed down simultaneously.

The preferred latch mechanism 56 is made from conductive material (metal) and is coupled through a conductive descending member 62 to the braided shield 34, thus providing an electrical ground path between the braided 34 shield and the ground plate 50. Note that it is desirable to mechanically support each subassembly (e.g., subassembly 46) at both upper and lower sides of the ground plate 50 opening, otherwise the connector 26 would be easily movable in the vertical direction. This is because the opening through the ground plate 50 is wider than the body of the subassemblies 44–46. As a result, it is feasible to have two identical latch mechanisms (one upper and one lower) that latch in the above-described manner.

Figure 6:
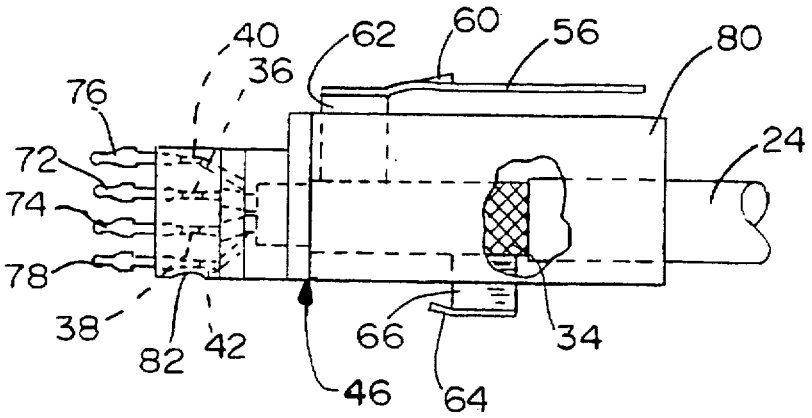
FIG. 6 is a partial cut-away, side view illustrating a completed connector and cable apparatus according to the invention.

However, rather than provide a second, lower active latch that is identical to the upper active latch, it has been found to be desirable to provide a lower contact surface 64 for mating with the ground plate 50. As best shown in FIG. 8, the lower contact surface 64 is substantially aligned with the ground plate 50, upon full insertion of the subassembly therethrough, by a substantially straight, ascending second member 66. As best shown in FIG. 6, the location of the lower contact surface 64 along with the substantially straight member 66 provides a shorter path length between the ground plate 50 and the braided shield 34 than does the path therebetween that is provided through the latch mechanism 56. As can be appreciated, such a shorter path to ground is desirable with high speed signal transmissions. Consequently, the upper latch mechanism 56 and/or the first member 62 need not also be electrically conductive. At the same time, the lower contact surface 64 securely maintains the connector 26 in a position perpendicular to the ground plate 50. Like the upper active latch 56, the lower contact surface 64 is tapered with an upwardly-shaped bend at its forward end to facilitate insertion through the ground plate 50.

To construct an individual subassembly such as 46, the cable 24 is first stripped and prepared as shown in FIG. 3. The cable preparation includes manipulating the drain wires 40, 42 and signal carrying wires 36, 38 as necessary to place them in substantially the same plane and in a predetermined positional order. In other words, although not explicitly differentiated herein for reasons of simplicity, it can be appreciated that each signal and drain wire is positioned according to a specified pattern. For example, the wires may be color coded whereby a first color is uppermost, followed by a second color, and so on until all the wires are properly positioned.

Figure 4:
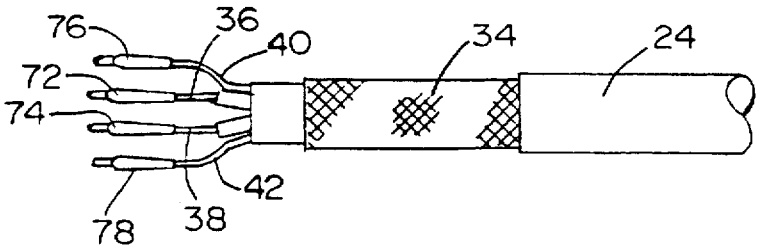

As shown in FIG. 4, a terminal 72, 74, 76 and 78 is electrically and mechanically coupled (e.g., soldered or welded) to each respective wire 36, 38, 40 and 42. The terminals 72–76 may be made from and/or plated with any suitable material in a known manner.

Figure 5:
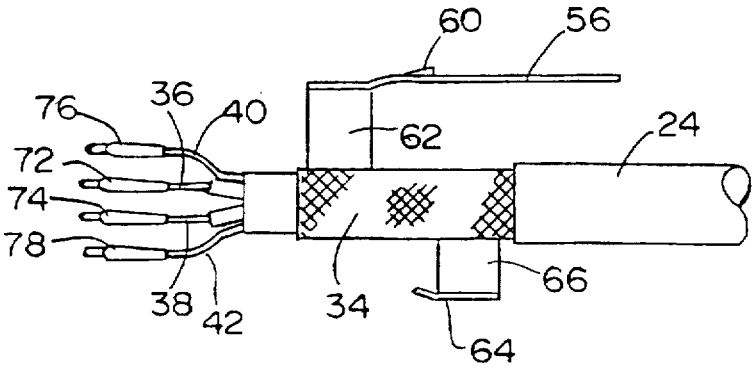

FIG. 5 illustrates the upper latch mechanism 56 and lower contact surface 64 after coupling to the braided shield 34, the coupling generally accomplished by soldering. As described above, the upper latch mechanism 56 is coupled to the shield 34 through the first, preferably conductive, descending member 62. Similarly, the lower contact surface is coupled to the shield through a conductive, ascending second member 66. Such first and second members 62, 66 provide a sufficient vertical separation between the various components so that the subassembly 46 latches to standard ground plate 50 openings, and so that the subassembly 46 may be overmolded (FIG. 6) without encasing the upper latch mechanism 56 or the lower contact surface 64. The upper latch mechanism 56, the lower contact surface 64 and first and second members 62 and 66 may be stamped and formed from a single flat sheet of metal.

Once prepared as described above, the subassembly 46 is overmolded with plastic or the like into a solid structure 80 as shown in FIG. 6. The overmolding strain relieves and fixes the positions of the wires 36–42 and terminals 72–78.

and solidifies the connections between the braided shield 34 and the first and second members 62, 66. Preferably, the insertion end of the subassembly 46 structure 80 includes a recess 82 or the like to ensure that polarity is maintained. For example, in addition to providing a visual indication, the recess 82 may engage a protrusion or the like (not shown) in the shroud 52 which prevents inverted insertion.

FIG. 7 shows three such subassemblies 44–46 inserted or being inserted into the housing 48 to form a completed connector 26. In keeping with one aspect of the invention, once inserted, the connector 26 is fully compatible with existing one-piece connector structures. However, unlike one-piece connectors, the connector 26 of the present invention consists of the individual, modular subassemblies 44–46, allowing servicing on an individual cable-by-cable basis.

Lastly, as shown in FIG. 8, the terminating connector 26 is inserted through the ground plate 50 as described above. Further insertion plugs the terminating connector 26 into the shroud 52 of the backplane assembly 54.

As can be seen from the foregoing detailed description, there is provided an apparatus and method for constructing same for terminating a plurality of cables while allowing the cables to be individually connected and disconnected. The connector comprises modular subassemblies, which, when combined, provide a connector that is compatible in size and shape with standardized connector specifications. The modular connector subassemblies provide desired shielding, and are constructed using a relatively simple and economical manufacturing method that provides a sturdy and reliable connector.

We claimed:

1. An electrical terminating connector for at least one electrical signal transmission cable of the type having at signal carrying conductors and a cable shield, and the connector coupling said signal carrying conductors through a ground plate and to a mating connector or pin field assembly, the connector comprising, a housing adapted for mating with the connector assembly, and a plurality of subassemblies detachably coupled to the housing, each subassembly comprising a terminal electrically coupled to a respective signal carrying conductor, a latch mechanism for latching the subassembly directly to the ground plate, and grounding means electrically coupled to the cable shield for providing a ground path from the cable shield to the ground plate.

2. The electrical terminating connector of claim 1 wherein the latch mechanism is conductive and is electrically coupled to the shield such that the grounding means of the subassembly includes the latch mechanism.

3. The electrical terminating connector of claim 1 wherein the grounding means of the subassembly includes a contact surface for contacting the ground plate.

4. The electrical terminating connector of claim 3 wherein the contact surface is connected to the cable shield through a substantially straight member such that the contact surface is in alignment with the ground plate upon coupling of the connector to the connector assembly.

5. The electrical terminating connector of claim 4 wherein the contact surface and the latch mechanism each include a tapered portion.

6. The electrical terminating connector of claim 1 wherein each subassembly includes a body portion encasing a portion of the terminal proximate the signal carrying conductor and encasing a portion of the grounding means proximate the cable shield.

7. The electrical terminating connector of claim 6 wherein the body portion includes a recess.

8. The electrical terminating connector of claim 1 wherein the at least one cable includes a plurality of signal carrying conductors and a plurality of drain wires.

9. The electrical terminating connector of claim 1 wherein three subassemblies are individually detachably coupled to the housing.

10. The electrical terminating connector of claim 1 wherein the latch mechanism comprises a resiliently deformable arm having a barb for engaging the ground plate.

11. The electrical terminating connector of claim 10 further comprising a member for supporting the latch mechanism at one end thereof.

12. The electrical terminating connector of claim 2 wherein the latch mechanism and the grounding means comprise a unitary metallic stamped and formed part.

13. An apparatus for transmitting electrical signals through a ground plate and to a backplane assembly, comprising:

at least one electrical signal transmission cable of the type having at least one signal carrying conductor and a cable shield; and an electrical terminating connector including a housing adapted for mating with the backplane assembly, and a plurality of subassemblies detachably coupled to the housing, each subassembly comprising a terminal electrically coupled to a respective one of the signal carrying conductors, a latch mechanism for latching the subassembly directly to the ground plate, and grounding means electrically coupled to the cable shield for providing a ground path from the cable shield to the ground plate.

14. The electrical terminating connector of claim 13 wherein the latch mechanism is conductive and is electrically coupled to the shield such that the grounding means of the subassembly includes the latch mechanism.

15. The electrical terminating connector of claim 13 wherein the grounding means of the subassembly includes a contact surface for contacting the ground plate.

16. The electrical terminating connector of claim 15 wherein the contact surface is connected to the cable shield through a substantially straight member such that the contact surface is in alignment with the ground plate upon coupling of the connector to the backplane assembly.

17. The electrical terminating connector of claim 15 wherein the contact surface and the latch mechanism each include a tapered portion.

18. The electrical terminating connector of claim 13 wherein each subassembly includes a body portion encasing a portion of the terminal proximate the signal carrying conductor and encasing a portion of the grounding means proximate the cable shield.

19. The electrical terminating connector of claim 18 wherein the body portion includes a recess.

20. The electrical terminating connector of claim 13 wherein the at least one cable includes a plurality of signal carrying conductors and a plurality of drain wires.

21. The electrical terminating connector of claim 13 wherein three subassemblies are detachably coupled to the housing.

22. The electrical terminating connector of claim 13 wherein the latch mechanism comprises a resiliently deformable arm having a barb for engaging the ground plate.

23. The electrical terminating connector of claim 22 further comprising a member for supporting the latch mechanism at one end thereof.

24. A method of constructing an apparatus for transmitting electrical signals therethrough, comprising the steps of:

providing a transmission cable including a signal carrying conductor and a shield;

exposing an end of the signal carrying conductors and an end of the shield;

constructing a plurality of subassemblies, the step of constructing each subassembly including the steps of:

electrically coupling a respective terminal to each of the signal carrying conductors;

coupling a latch mechanism to the shield through a first member;

electrically coupling a conductive contact surface to the shield through an electrically conductive second member; and overmolding the exposed shield, at least part of the first member and the second member and at least part of the terminal into a unitary structure; and inserting the subassemblies into a housing.

25. The method of claim 24 wherein the cable includes a plurality of signal carrying conductors and a plurality of drain wires, and wherein the step of constructing each subassembly includes the step of electrically coupling a terminal to each of the signal carrying conductors and the drain wires.

26. An apparatus for transmitting electrical signals through a ground plate and to a backplane assembly, comprising:

a plurality of electrical signal transmission cables, each cable of the type having a plurality of signal carrying conductors, a plurality of drain wires, and a cable shield, and an electrical terminating connector including, a housing adapted for mating with the backplane assembly, and a plurality of subassemblies, each subassembly detachably coupled at one end thereof to the housing and at the other end to one of the cables, each subassembly comprising, a plurality of terminals, each of the terminals electrically coupled to a respective one of the signal carrying conductors or the drain wires of one of the cables, a latch mechanism for latching the subassembly directly to the ground plate, a contact surface electrically coupled via a conductive member to the cable shield of one of the cables for providing a ground path from said cable shield to the ground plate, and a body portion encasing a portion of the terminals proximate the signal carrying conductors and the drain wires and encasing a portion of the conductive member proximate said cable shield.

* * * * *